United States Patent [19]

Larson

[11] 3,988,551

[45] Oct. 26, 1976

[54] MEMBRANE KEYBOARD APPARATUS HAVING COMMON APERTURED ELECTRODE, APERTURE INSERTED ELECTRODES AND CONDUCTIVE BUBBLE CONTACTORS

[75] Inventor: Willis August Larson, Mequon, Wis.

[73] Assignee: Magic Dot, Inc., Minneapolis, Minn.

[22] Filed: Apr. 3, 1975

[21] Appl. No.: 564,913

[52] U.S. Cl. ..... 200/5 A; 200/159 B

[51] Int. Cl.[2] ..... H01H 13/64

[58] Field of Search ..... 200/5 R, 5 A, 16 A, 200/83 N, 159 B, 243, 264, 308, 340, 85 A, 86 R

[56] References Cited

UNITED STATES PATENTS

| | | | |
|---|---|---|---|
| 3,591,749 | 7/1971 | Comstock | 200/292 X |
| 3,643,041 | 2/1972 | Jackson | 200/159 B X |
| 3,731,014 | 5/1973 | Brady | 200/5 A |
| 3,749,859 | 7/1973 | Webb et al. | 200/5 A |
| 3,806,673 | 4/1974 | Boulanger | 200/159 B X |
| 3,842,230 | 10/1974 | Kashio et al. | 200/5 A X |
| 3,854,018 | 12/1974 | Reynolds et al. | 200/159 B X |
| 3,860,771 | 1/1975 | Lynn et al. | 200/340 X |
| 3,862,382 | 1/1975 | Glaister et al. | 200/159 B X |

*Primary Examiner*—James R. Scott
*Attorney, Agent, or Firm*—James L. Kirschnik; John Phillip Ryan

[57] ABSTRACT

Membrane keyboard apparatus is disclosed as including an insulator having a conductive sheet thereon providing a plurality of first electrode members and a plurality of second electrode members to form an array of individual switching units. A membrane member is disposed in a spaced relation above and adjacent to the level of the top surfaces of the pluralities of first and second electrode members. The membrane member is formed of a flexible, plastic, insulative sheet member, and includes: an array of indicia corresponding to the array of individual switching units formed on the first, bottom surface of the sheet member; a background color layer formed on the bottom surface of the sheet member and over the array of indicia; a very thin, conductive layer formed on the background color layer and applied to form patterned areas for providing a conductive path between the first and second electrode members of the individual switching units selected; and height differential members formed in the membrane member. The height differential members formed in the membrane member have a first, actuated position where the conductive layer provides a conductive path between the associated first and second electrode members of the actuated individual switching unit and a second, nonactuated, normal position where the conductive layer is electrically spaced from at least the second electrode members to electrically insulate the first electrode members and the second electrode members.

9 Claims, 4 Drawing Figures

MEMBRANE KEYBOARD APPARATUS HAVING COMMON APERTURED ELECTRODE, APERTURE INSERTED ELECTRODES AND CONDUCTIVE BUBBLE CONTACTORS

BACKGROUND OF THE INVENTION

The present invention relates generally to switches, specifically to switches actuable by touch, more specifically to membrane switches, and more particularly to membrane keyboard apparatus.

Increased interest in electronic apparatus having switch keyboards, such as calculators, typewriters, and similar apparatus, has increased the need for keyboard apparatus. Such keyboard apparatus should include a minimum number of components which can be easily manufactured and which lend themselves to mass production techniques thus reducing the cost of materials and labor.

Such keyboard apparatus should also include a membrane member having height differential obtaining means for electrically insulating at least one electrode member of the electrode members of an individual switching unit such that further insulator means between the membrane and electrode members of the individual switching unit are not required.

SUMMARY OF THE INVENTION

The apparatus of the present invention solves these and other problems in keyboard apparatus by providing, in the preferred embodiment, membrane keyboard apparatus including a plurality of first electrode members and a plurality of second electrode members forming an array of individual switching units on a face of an insulator. A bridging member is disposed in a spaced relation above and adjacent to the level of the top surfaces of said electrode members. The bridging member includes a sheet having a first surface, with at least a portion of the sheet first surface being conductive or at least semiconductive.

The bridging member further includes an array of height differential members formed therein having a first, actuated position where the conductive or semiconductive layer provides an electrical path between the associated first and second electrode members of the actuated individual switching unit selected and having a second, nonactuated, normal position where the sheet first surface is electrically spaced from at least one of the pluralities of electrode members to electrically insulate the first electrode members and the second electrode members.

It is a primary object of the present invention to provide novel membrane keyboard apparatus.

It is an object of the present invention to provide such membrane keyboard apparatus which includes a minimum number of components.

It is a further object of the present invention to provide such membrane keyboard apparatus which is simple in design, easy to manufacture, lends itself to mass production techniques and which maximizes utilization of the materials used.

It is further an object of the present invention to provide such membrane keyboard apparatus which is sensitive to actuation.

These and further objects and advantages of the present invention will become clearer in the light of the following detailed description of an illustrative embodiment of this invention described in connection with the drawings.

All figures are drawn for ease of explanation of the basic teachings of the present invention only; the extensions of the figures with respect to number, position, relationship, and dimensions of the parts to form the preferred embodiment will be explained or will be within the skill of the art. Further, the exact dimensions and dimensional proportions to conform to specific force, weight, strength, and similar requirements will likewise be within the skill of the art.

DESCRIPTION

Figure 1:
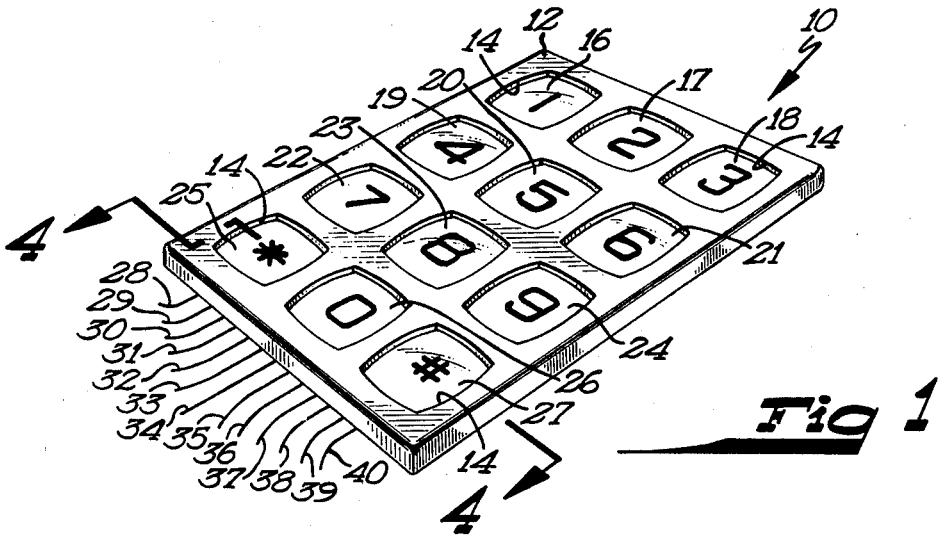
FIG. 1 shows a perspective view of membrane keyboard apparatus according to the present invention, shown as including a bezel.

In FIG. 1, a preferred form of a membrane keyboard apparatus is generally designated 10. Keyboard 10 includes a plastic molding or bezel member 12 having a plurality of apertures 14 formed therein exposing an array of individual switching units 16–27 therethrough. Switching units 16–27 are actuable by an input signal from the touch of a user and provide an electrical output signal, through electrical leads 28–40, for use with electric circuits, not shown.

Figure 2:
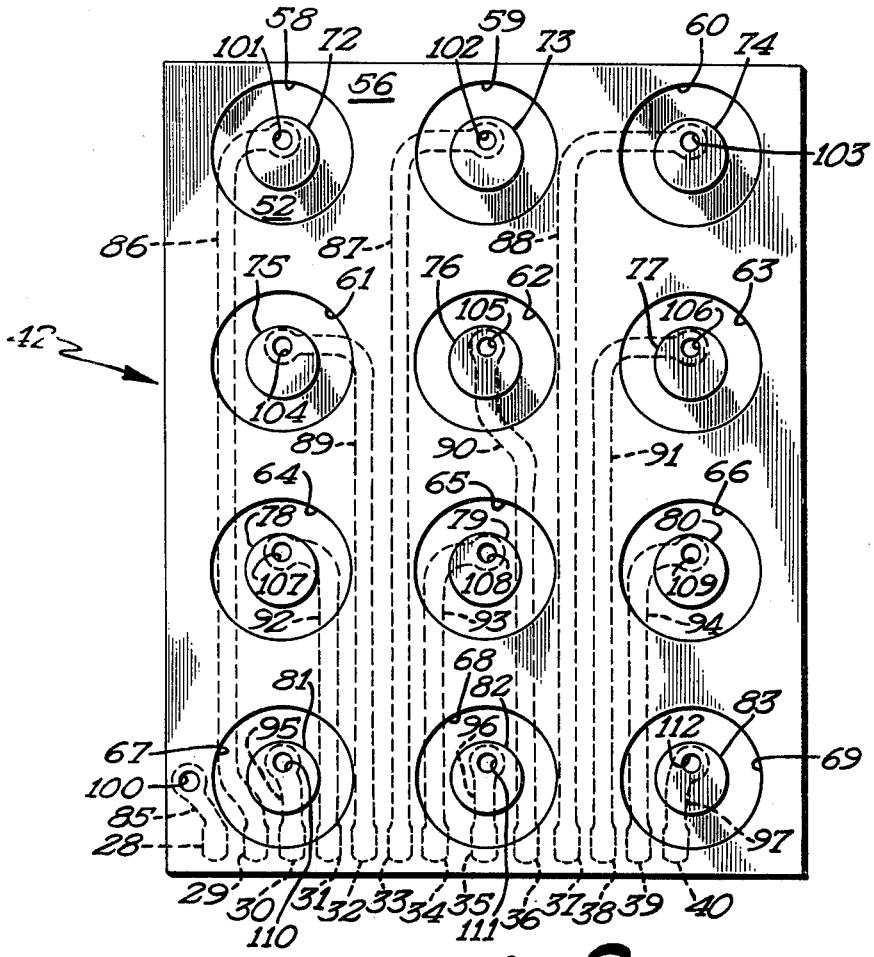
FIG. 2 is a top view of the insulator component of the apparatus illustrated in FIG. 1.
Figure 3:
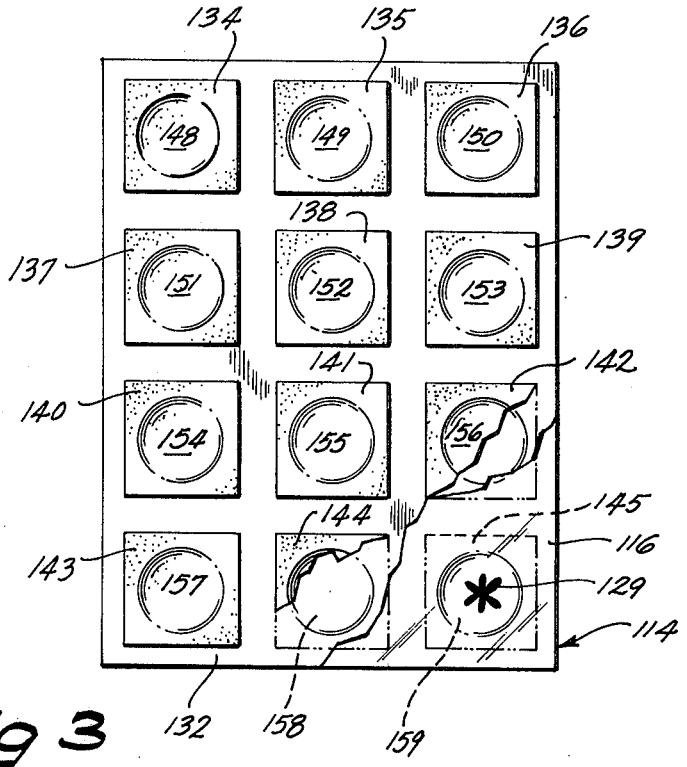
FIG. 3 is a bottom view of the bridging member of the apparatus illustrated in FIG. 1.
Figure 4:
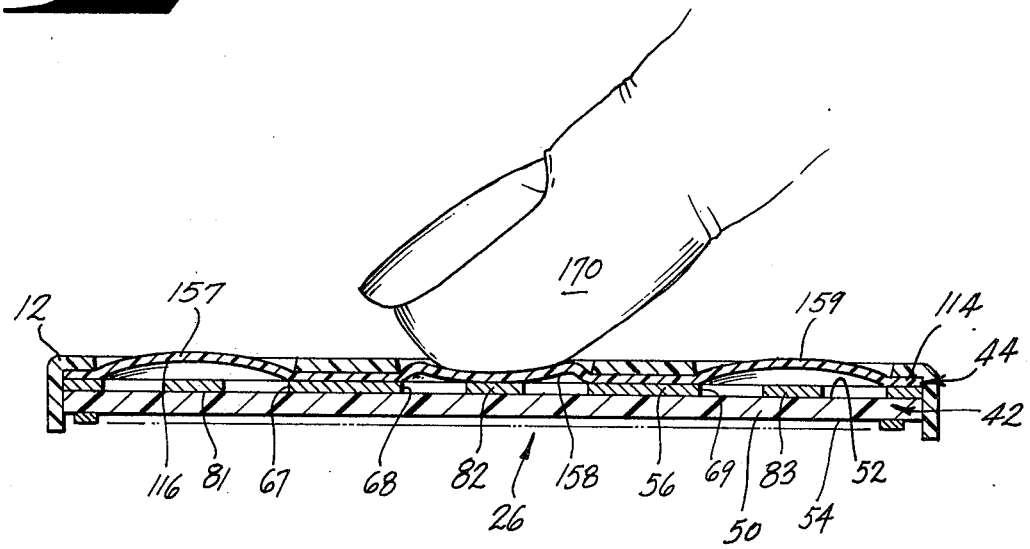
FIG. 4 is a cross sectional view of the apparatus illustrated in FIG. 1 along the planes of section lines 4—4 of FIG. 1, with an individual switching unit being actuated by the finger of an operator.

As best seen in FIG. 4, keyboard 10 further includes an insulator component 42, and a bridging member 44. As best seen in FIGS. 2 and 4, insulator component 42 includes an insulator 50, which may be rigid or flexible, having a first, top surface or face 52 and a second, bottom surface or face 54, a conductive sheet 56 of substantial area covering the first face 52 of insulator 50 having an array of apertures 58–69 formed therethrough to thus expose face 52 of insulator 50. The material of conductive sheet 56 located around apertures 58–69 form a plurality of first electrode members which are electrically connected to each other by the remaining material of sheet 56. Insulator component 42 includes a plurality of second electrode members 72–83 located on face 52 of insulator 50 concentrically within and laterally spaced from the periphery of apertures 58–69 of sheet 56 and electrically insulated from the first electrode members. In FIG. 2, printed or etched conductors 85–97 are formed on bottom surface 54 of insulator 50, and leads 28–40 are electrically interconnected to printed or etched conductors 85–97 by suitable means such as by soldering.

In the preferred embodiment, insulator 50 is of a thickness substantially equal to 0.062 inches (0.15748 centimeters) and the thickness of conductive sheet 56, and thus the first electrode members, and electrode members 72–83 is substantially equal to between 2 and 5 mils (0.00508 and 0.01270 centimeters.)

As seen in FIG. 4, the thickness of second electrode members 72–83 is equal to the thickness of sheet 56, and hence equal to the thickness of the first electrode members, such that the height level of the top surface of the plurality of first electrode members is equal to the height level of the top surface of the plurality of second electrode members 72–83. Apertures 58–69 and electrode members 72–83 can simultaneously be formed in a conductive sheet placed on insulator 50 by suitable means, such as etching.

Second electrode members 72–83 are electrically interconnected to printed conductors 86–97, respectively, located on bottom surface 54 of insulator 50, by electrical connections 101–112 respectively which pass through insulator 50. Sheet 56 is electrically connected to printed conductor 85 located in bottom surface 54 of insulator 50 by electrical connection 100 which passes through insulator 50.

Electrical connections 100–112 can be formed by any suitable method such as filling an aperture through insulator 50, interconnecting sheet 56 and electrode members 72–83, respectively, with solder, sucking conductive paste therethrough, plating through the holes, or by pin members which pass through the insulator 50.

Membrane member or bridging member 44 includes a flexible, plastic, insulative sheet member 114 formed, in the preferred embodiment, of clear Mylar plastic film, having a first, bottom surface 116. Member 44 optionally may include nomenclature shown in the preferred form as an array of indicia or symbols 129 corresponding to the array of individual switching units 16–27. Indicia or symbols 129 can be formed on surface 116 of sheet member 114 by any suitable method, such as silk screening.

Membrane member 114 may further optionally include a background color layer 132 formed on bottom surface 116 of sheet member 114 over indicia or symbols 129. Color layer 132 is formed from special paints which are suitable for application to Mylar plastic film. Besides providing a background color for preventing viewing of the internal switch workings, layer 132 can act as a buffering material to a conductive layer located thereon.

For providing at least a conductive path between the associated first and second electrode members of the individual switching units selected, a conductive or semiconductive layer is provided on first surface 116 of sheet member 114 of bridging member 44 over layer 132. A conductive or semiconductive layer may be generally described or referred to herein as a conductive layer. It is intended that a conductive layer shall mean a metallic conductive paint, or resistive conductive means such as cermets or carbonaceous paints and that the electrical path thereby established, whether conductive or semiconductive, be and is considered a conductive path. It should be noted that if the conductive layer covers the entire area of surface 116, the conductive layer may then also provide a background color and thereby eliminate the need for layer 132.

However, in the preferred embodiment, the conductive layer is provided as an array of patterned areas 134–145 corresponding to the array of individual switching units 16–27. Patterned areas 134–145 allows sequential switching, isolated contact type switching, multiple contacts which are isolated, and other such switch functions. Previous known switches having patterned membranes used etched conductors which were applied by adhesive to the membrane surfaces. Such membranes were subject to metal fatigue, cracking and breaking, all of which may result in an inoperative switch. Areas 134–145 are formed to be very thin and can be applied to member 114 by several methods such as sputtering, vacuum deposition, printing, or silk screening techniques. Therefore, areas 134–145 are not subject to metal fatigue, cracking or breaking.

Bridging member 44 further includes an array of height differential obtaining members 148–159 as best illustrated in FIG. 4. Height differential members 148–159 have a height i.e. the distance from surface 116 to the top surface of second electrode members 72–83, in the range of 10 mils (0.0254 centimeters) typically 5 mils (0.001270 centimeters) with a minimum of approximately 2 mils (0.00508 centimeters) and a maximum of approximately 15 mils (0.03810 centimeters).

Height differential obtaining members 148–159 are preferably formed of Mylar plastic film by heating, pressure, vacuum, or a combination process. After the application of indicia and other layers, discussed hereinafter, sheet member 114 of bridging member 44 can be subjected to heat sufficient to cause the plastic to form in a mold so that the plastic surface 116 will not return to a flat position in time. At the same time, surface 116 of the plastic may be subjected to pressure, and the opposing surface may be subjected to a vacuum. Alternately, only one of these means may be used. It may be desirable that some of height differential obtaining members 148–159 be of low profile and minimum height, while others have significant height.

Height differential members 148–159 have a first actuated position where areas 134–145 of sheet member 114 electrically contact the first electrode members, or sheet 56, and the second electrode members 72–83 to provide at least a conductive path between the associated first and second electrode members of the individual switching units selected and have a second, normal, nonactuated position where areas 134–145 of sheet member 114 are electrically spaced from at least one of the first and second electrode members to electrically insulate the first electrode members from the second electrode members 72–83.

Bridging member 44 is disposed in a spaced relation above and adjacent to the top surfaces of first electrode members and second electrode members 72–83. In the preferred embodiment, bridging member 44 rests on and is supported by sheet 56 such that areas 134–145 are electrically connected first electrode members, or sheet 56, and bridging member 44 is spaced from but adjacent to second electrode members 72–83 because of the height differential members 148–159 being in the nonactuated position. Because of members 148–159, insulators previously required in prior known switches to separate bridging members from switch electrodes are not required.

OPERATION

Generally, in operating the membrane keyboard apparatus as shown in FIGS. 1–4, the finger of an operator is placed upon a selected height differential member 148–149, of the individual switching unit 16–27, selected, for example, member 158 of switching unit 26 and finger portion 170, as illustrated in FIG. 4.

In an unactuated condition, member 158 is located in a second, normal position such that area 144 electrically contacts the first electrode member of sheet 56 adjacent to aperture 68 but is electrically spaced from second electrode member 82, and therefore electrically insulated therefrom. Because the first electrode member of switching unit 26 formed around aperture 68 of sheet 56 is spaced from second electrode member 82 and member 44 is also spaced from second electrode member 82 the first electrode of switching unit 26 is electrically insulated from the second electrode member 82 of switching unit 26 and no switch actuation results.

Sufficient pressure placed on member 158 by finger portion 170, to deflect member 158 into its first actuated position, will deflect member 158 into its first, actuated position, causing area 144 of member 44 to contact second electrode member 82 whereby member 44 provides a conductive path between the associated first electrode, consisting of the material located around aperture 68 of sheet 56, and the associated second electrode member 82 of individual searching unit 26. It can then be apprecited that area 144 formed on surface 116 electrically contacts sheet 56 around aperture 68 and is deflected into associated second electrode member 82 of individual switching unit 26.

The conductive layer is formed in an array of patterened areas 134–145, with each patterned area electrically insulated from every other patterned area. This may be especially desirable where each of the first electrode members are electrically insulated from each other, rather than electrically interconnected as shown. An alternate embodiment of member 144 would be where the conductive layer would coat the entire first bottom surface 116, rather than in the patterned areas 134–145.

When the operator removes finger portion 170 from height differential member 158, it will return to its first, nonactuated position. Individual switching unit 26 is thus returned to an open switch position because area 144 is electrically spaced and insulated from second electrode member 82.

Due to height differential obtaining members 148–159 of bridging member and the construction of the remaining portions of apparatus 10, individual switching units 16–27 are sensitive to actuation. The lower the height range of members 148–159, the greater the sensitivity of switching units 16–27 to an infinite sensitivity when the height range is equal to zero, or in a continuous switch closure condition. It has been found that to insure that switch units 16–27 remain in an open condition when not actuated, a height of approximately 2 mils should be allowed for members 148–159. As the height increases, this height differential results in a lowering of sensitivity to actuation and causes a higher switch threshold. Such increased height may result in the undesired "snap through" of members 148–159, thereby greatly increasing the switch threshold, as is found in prior known switches. It has been found that to maintain a sensitive switch, a height differential of less than approximately 15 mils (0.03810 centimeters) should be maintained for a thickness of member 114 of member 44 of from 5 to 10 mils (0.0127–0.0254 centimeters) when formed in the preferred form of Mylar plastic film.

A further reason for forming a height differential of at least 2 mils (0.00508 centimeters) is that use of the keyboard of the present invention may result in a sharp instrument, such as a ball point pen, being thrust into one of the height differential obtaining members 148–159, causing a permanent indentation or puncture. It has been found that an indentation from such an instrument can be 2 mils (0.00508 centimeters) in height, therefore it can cause a continuous switch closure unless the height differential obtaining members 148–159 are maintained at a height of at least greater than 2 mils.

It may be advantageous to form height differential obtaining members 148–159 of differing heights. This is especially advantageous where the keyboard of the present invention is desired to have selective activation pressures for switching, as where some switching is to require a higher threshold or lower sensitivity because of a desire to minimize an unintentional actuation of its associated switch and the remaining portions of the keyboard are desired to have a high sensitivity and thus a low threshold. In this situation, it may be desired that many of the height differential obtaining members 148–159 have a height of near 2 mils (0.00508 centimeters) to thus have a high sensitivity and a low threshold, while at least some of the height differential obtaining members 148–159 have much larger height dimension, possibly exceeding 25 mils (0.0635 centimeters).

It should likewise be noted that the switch threshold and sensitivity are dependant on other factors including the thickness of member 114 of member 44, the diameter of members 148–159, the shape of members 148–159, the material forming member 44. For example, if it is desired to manufacture switches having uniform but different sensitivities, it is not necessary to have several apparatus to form members 148–159 of different heights, as generally done in prior known switches, but rather to only use sheet members 114 of varying thicknesses. Therefore, the sensitivity of the switch would be dependent on the thickness of sheet member 114 of member 44 and no critical and differing tooling would be required to vary switch sensitivity.

It can also be appreciated that membrane keyboard apparatus 10 of the present invention lends itself to mass production techniques. For example, to assemble apparatus 10, bridging member 44 and insulator component 42 are simply dropped into a bezel member 12, or for a sealed type switch, the edges of each component are glued together forming a unitary, sealed edge, and the sealed unit is dropped into bezel member 12.

It can be appreciated that membrane keyboard apparatus 10 of the present invention includes only a minimum number of components which can be easily manufactured at a low cost and which lend themselves to mass production techniques, thus reducing the cost of material and labor. Due to height differential obtaining members 148–159, apparatus 10 includes only two components, insulator component 42 and member 44, and does not require the use of an insulator for supporting a bridging type member from first and second electrode members having equal top surface levels, as required in prior known switches. Further, prior known switches would require not one but the stacking of many insulator spacers, particularly located, in order to obtain the selective activation pressures for switching, as provided by the present invention. The present invention accomplishes this result with no insulator spacers whatever.

Additionally, since indicia or symbols 129 and layer 132 can be formed directly on and integral with sheet member 114, a separate indicia or symbol member is not required to reduce the number of components necessary and, therefore, reduce the expense. Further other problems attendant with separate indicia are removed, for example, alignment of indicia or symbols 129 with the individual switching units 16–27.

Still further, through utilization of the height differential obtaining members 148–159, a switch which is extremely sensitive can be fabricated, while allowing a visual indication of switch location, through the height differential provided.

Therefore, the present invention discloses membrane keyboard apparatus including only two switch components, with both components being capable of being mass produced at a low cost and assembled with little hand labor required. Further apparatus 10 is very sensitive to actuation and the components allow variation of the sensitivity of the individual switching units 16–27 of apparatus 10. Still further the completed keyboard apparatus includes every part necessary and desirable for a keyboard, including nomeclature.

The keyboard apparatus of the invention may be fabricated from two continuous sheets of Mylar plastic film sandwiched together, with one sheet defining bridging member 44 including height differential obtaining members 148–159 and the remaining sheet forming insulator component 42. If the conductive members are then screened onto the respective members 42 and 44, in the manner described and all other layers are similarly formed, such as indicia or symbols 129, and if adhesive is screened on the mating surfaces of the two continuous sheets of Mylar plastic film, the two continuous sheets of Mylar plastic film may be subject to roll pressure to form a unitary keyboard, as between pressure rollers, may be die cut, and then may be provided from the die cutting machine into packaging as a unitary keyboard untouched by human hands. The above assumes that member 42 is a single sided conductive array, rather than the double sided array shown. A pattern of adhesive may be applied to bottom surface 54 of insulator 50, thus providing a method of attaching the finished keyboard to a face of calculator, for example.

Utilizing the teachings of the present invention, a two piece switch, with both pieces of flexible material, may be mass produced. The membrane keyboard so made will include a visual indication of switch location, as from the height differential obtaining means, can provide a differential threshold of switching which would require the stacking of spacers in known prior switches, and includes a minimum of parts, and clearly fewer parts than in known prior switches. All of this is obtainable in a switch having substantial sensivity and design flexibility.

Many extensions and variations will be obvious to one having ordinary skill in the art. For example, although twelve individual switching units 16–27 are shown and described, it will be immediately apparent that apparatus 10 may be actually include more or fewer individual switching units.

Also, although a preferred embodiment of switch electrodes is shown and described, it will be apparent that other variations can be used, such as electrically insulated and isolated first electrode members, and multiple electrode members including various types of sequencing, encoding, or other switch features such as differing patterns.

Since the invention disclosed herein may be embodied in other specific forms without departing from the spirit or the general characteristics thereof, some of which forms have been indicated, the embodiments described herein are to be considered in all respects illustrative and not restrictive. The scope of the invention is indicated by the appended claims, rather than by the foregoing description and all changes which come within the meaning and range of equivalency of the claims are intended to be embraced therein.

I claim:

1. A membrane keyboard apparatus for selectively activating two or more electrical circuits, said apparatus comprising.

an insulator having a first face;

first electrode means supported on said first face, said first electrode means comprising a sheet of electrically conductive material having two or more apertures formed therein;

second electrode means supported on said first face and centrally disposed within each of said apertures and insulated from said first electrode means, said first and second electrodes means defining an array of two or more individual switching units, and said first and second electrode means having coplanar top surfaces;

membrane means having a contact face supported on the top surface of said first electrode means, said membrane means comprising flexible sheet means having an upraised portion adjacent to and spaced from each of said second electrode means corresponding to said array of switching units;

conductive means formed on the contact face of said membrane means extending at least along the surfaces of said upraised portions and their peripheries adjacent each of said first and second electrode means for selectively providing an electrical connection between said individual switching units by depression of said upraised portions;

means for securing said membrane means securely against said first electrode means; and means for providing an electrical connection between said first and second electrode means and said electrical circuits.

2. Apparatus as defined in claim 1, wherein said conductive means comprises an electrically conductive paint applied to said membrane means.

3. Apparatus as defined in claim 2 including indicia means associated with each of said upraised portions for visually differentiating said upraised portions.

4. Apparatus as defined in claim 3, wherein the distance between the contact face of each said upraised portion and the top surface of said second electrode means being in the range of 2 mils to 15 mils.

5. Apparatus as defined in claim 4, wherein said bridging means comprises resilient, flexible nonconductive, sheet material.

6. Apparatus as defined in claim 1, wherein the distance between the contact face of each of said upraised portions and the top surface of said second electrode means is in the range of 2 mils to 15 mils.

7. Apparatus as defined in claim 6 wherein said distance is in the range of 10 mils.

8. Apparatus as defined in claim 6 wherein the said distance is in the range of 2 mils.

9. Apparatus as defined in claim 1 wherein said upraised portions are formed at different heights whereby the actuation pressures to depress said upraised portions will vary.

* * * * *